US008888108B1

(12) United States Patent
Beaty et al.

(10) Patent No.: US 8,888,108 B1
(45) Date of Patent: Nov. 18, 2014

(54) SKATEBOARD TRUCK

(76) Inventors: Robert Dean Beaty, Mesa, AZ (US); Joshua Dean Beaty, Mesa, AZ (US)

( * ) Notice: Subject to any disclaimer, the term of this patent is extended or adjusted under 35 U.S.C. 154(b) by 337 days.

(21) Appl. No.: 13/369,961

(22) Filed: Feb. 9, 2012

Related U.S. Application Data

(60) Provisional application No. 61/441,196, filed on Feb. 9, 2011.

(51) Int. Cl.
*A63C 1/00* (2006.01)
*B62M 1/00* (2010.01)

(52) U.S. Cl.
USPC ..... 280/11.27; 280/87.042

(58) Field of Classification Search
CPC ..... A63C 17/01; A63C 17/00; A63C 17/012; A63C 17/22; A63C 17/226; A63C 17/02; A63C 17/014; A63C 17/015; A63C 17/011
USPC ..... 280/11.223, 11.27, 11.28, 87.01, 280/87.021, 87.03, 87.041, 87.042
See application file for complete search history.

(56) References Cited

U.S. PATENT DOCUMENTS

| | | | | |
|---|---|---|---|---|
| 2,341,576 | A * | 2/1944 | Shye | 280/11.27 |
| 4,166,629 | A * | 9/1979 | List | 280/11.28 |
| 4,251,087 | A * | 2/1981 | Hansen | 280/11.28 |
| 6,182,987 | B1 * | 2/2001 | Bryant | 280/87.042 |
| 6,523,837 | B2 * | 2/2003 | Kirkland | 280/11.28 |
| 6,739,603 | B1 * | 5/2004 | Powell | 280/11.27 |
| 7,093,842 | B2 * | 8/2006 | Chmelar | 280/87.042 |
| 7,104,558 | B1 * | 9/2006 | Saldana | 280/87.042 |
| 7,635,136 | B2 * | 12/2009 | Cole | 280/87.042 |
| 7,744,100 | B2 * | 6/2010 | Cole | 280/11.115 |
| 7,837,204 | B1 * | 11/2010 | Groenenboom | 280/11.27 |
| 8,328,206 | B2 * | 12/2012 | Williams, Jr. | 280/11.28 |
| 8,465,027 | B2 * | 6/2013 | Burke | 280/11.27 |
| 8,783,699 | B2 * | 7/2014 | Gesmer | 280/87.042 |
| 2005/0051983 | A1 * | 3/2005 | Williams | 280/87.042 |

* cited by examiner

*Primary Examiner* — J. Allen Shriver, II
*Assistant Examiner* — James M Dolak
(74) *Attorney, Agent, or Firm* — Schmeiser, Olsen & Watts LLP

(57) ABSTRACT

A skateboard truck is provided that includes a base plate, a hanger and a kingpin. The base plate includes a kingpin clamping device, wherein the kingpin clamping device engages the kingpin and clamps around the circumference of the kingpin. The kingpin is prohibited from axial and radial movement in response to clamping the kingpin clamping device around the kingpin. The skateboard truck may also include a pivot alignment system. The pivot alignment system includes a recess in the hanger, a bearing coupled within the recess of hanger, a slot within the base plate and a pivot rod coupled to each the slot and the bearing. The pivot rod extends through the slot and engages the bearing within the recess of the hanger. The pivot rod may be moved from an engaged to a disengaged position, wherein the disengaged position, the pivot rod is slideable within the slot.

8 Claims, 13 Drawing Sheets

SKATEBOARD TRUCK

CROSS REFERENCE TO RELATED APPLICATION

This application claims priority to U.S. Provisional Patent Application entitled "SKATEBOARD TRUCK," Ser. No. 61/441,196, filed Feb. 9, 2011, the disclosure of which is hereby incorporated entirely herein by reference.

BACKGROUND OF THE INVENTION

1. Technical Field

This invention relates generally to a skateboard truck and more particularly to skateboard truck with a pivot axis alignment system.

2. State of the Art

Skateboards are commonly used for recreation, sport or transportation. Skate boards consist of a board typically formed of wood, such as maple veneers that are glued together to form what is commonly referred to as the deck. The deck is what a rider stands on while riding a skateboard. The deck is mounted onto trucks that provide the axles for mounting wheels onto. The trucks allow for two wheels to be mounted on the axle of each truck, thereby providing four wheels under the deck for the rider to roll on while standing on the top surface of the deck. It is also common for each truck to have two axles with a common axis where the two axles are aligned on opposing ends of the hanger. This is commonly referred to as split axles. Trucks that have a single axle is commonly referred to as a straight axle.

A skateboard truck consists of a base plate, a hanger, a pivot member, a pivot cup, an axle coupled to the hanger, a kingpin and bushings that allow for the tilting and rotating of the hanger with respect to the base. The bushings establish the amount of force a user must exert in order to tilt and rotate the hanger of the truck. The kingpin couples the hanger to the base plate, sandwiching a portion of the hanger between two bushings, with the pivot member engaging the pivot cup.

Conventional skateboard trucks have a kingpin that is a bolt that extends from the base plate and connects the hanger to the base plate by use of a kingpin bolt. Conventional skateboard trucks have hangers with the pivot member that is received within the pivot cup. This engagement provides the pivot point and pivot access of the truck and creates the pivot angle of the trucks. The pivot angle of the trucks is what determines the steering ability of the trucks. For example, it is typically understood that a high pivot angle makes the trucks more sensitive to leaning and facilitates steering by leaning and a lower pivot angle makes trucks less sensitive to leaning and thereby makes the skateboard more stable. The angle of the trucks can be critical depending on the desired form of riding a skateboard and the desired quality of ride on the skateboard. However, as the kingpin bolt is tightened, the pivot member extending from the hanger engages the fixed pivot cup at an angle with respect to the axis of the cup and alters the pivot axis of the truck. This affects the predictability of the steering capabilities of the skateboard truck, as well as increases wear and tear on truck components.

Additionally, the configuration of the kingpin of a conventional skateboard truck allows for a certain amount of movement during riding, which movement is magnified at faster speeds. The kingpin is extended through a hole in the base plate, through a bushing, through a hole in the hanger, through another bushing and then is engaged by a nut. The nut is tightened to secure the hanger to the base plate, while the nut limits movement along the kingpin, there is no mechanism that prevents lateral movement of the kingpin within the hole of the base, the hanger or both. As greater speeds this lateral movement poses safety risks by making the skateboard less stable by creating a vibrating or "chatter" effect on the wheels, wherein the wheels in turn vibrate and decrease control of the skateboard Further, the movement of the kingpin causes additional wear on the kingpin, the base plate, the hanger and the bushings.

Accordingly, there is a need in the field of skateboard trucks for an improved skateboard truck that address at least the above mentioned limitations of conventional trucks.

DISCLOSURE OF THE INVENTION

The present invention relates to a skateboard truck with a pivot alignment system, wherein the pivot axis alignment is not controlled by the tightening and loosening of the kingpin. Generally, a skateboard truck in accordance with embodiments of the present invention comprises a base plate, a kingpin, a hanger and pivot alignment system.

An embodiment of a skateboard truck comprises a base plate, a hanger and a kingpin. The base plate comprises a kingpin clamping device, wherein the kingpin clamping device engages the kingpin and clamps around the circumference of the kingpin. The kingpin is prohibited from axial and radial movement in response to clamping the kingpin clamping device around the kingpin.

Another embodiment of a skateboard truck comprises a base plate, a hanger and a pivot alignment system. The pivot alignment system comprises a recess in the hanger, a bearing coupled within the recess of hanger, a slot within the base plate and a pivot rod coupled to each the slot and the bearing. The pivot rod extends through the slot and engages the bearing within the recess of the hanger. The pivot rod comprises an engaged and disengaged position. In the disengaged position, the pivot rod is slideable within the slot. In the engaged position, the pivot rod is secured within the slot and the axis of the pivot rod aligns with the axis of the recess of the hanger.

Another embodiment includes a method of assembling a skateboard truck. The method comprises the steps of coupling a pivot rod to a slot of a base plate in a disengaged position; coupling a hanger to the base plate in response to coupling a kingpin to a kingpin clamping device of the base plate, wherein the pivot rod is coupled to a bearing within a recess of the hanger; prohibiting axial and radial movement of the kingpin in response to clamping the kingpin clamping device around the kingpin; and placing the pivot rod in an engaged position, wherein the axis of the pivot rod is aligned with the axis of the recess of the hanger.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
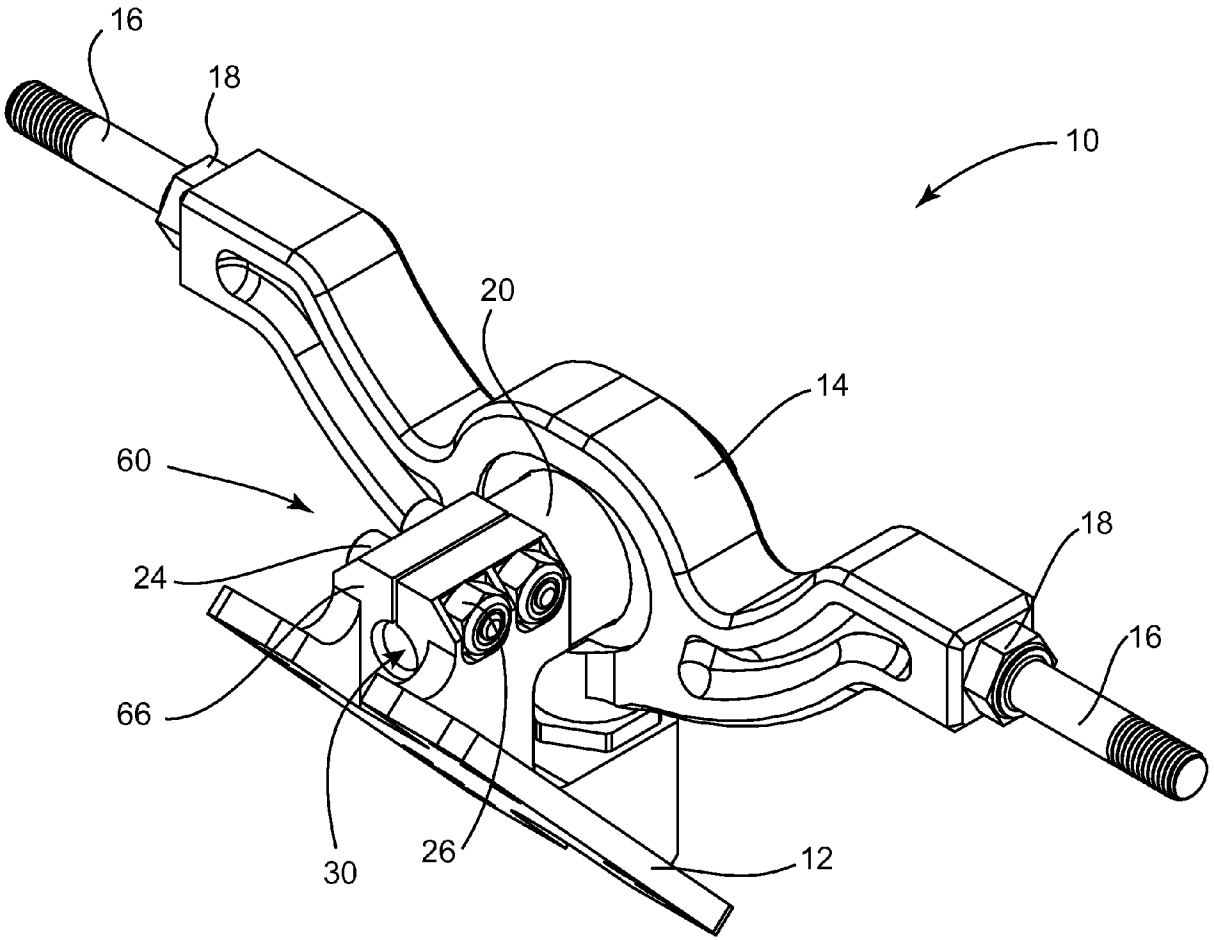
FIGS. 1-3 are perspective views of a skateboard truck.
Figure 2:
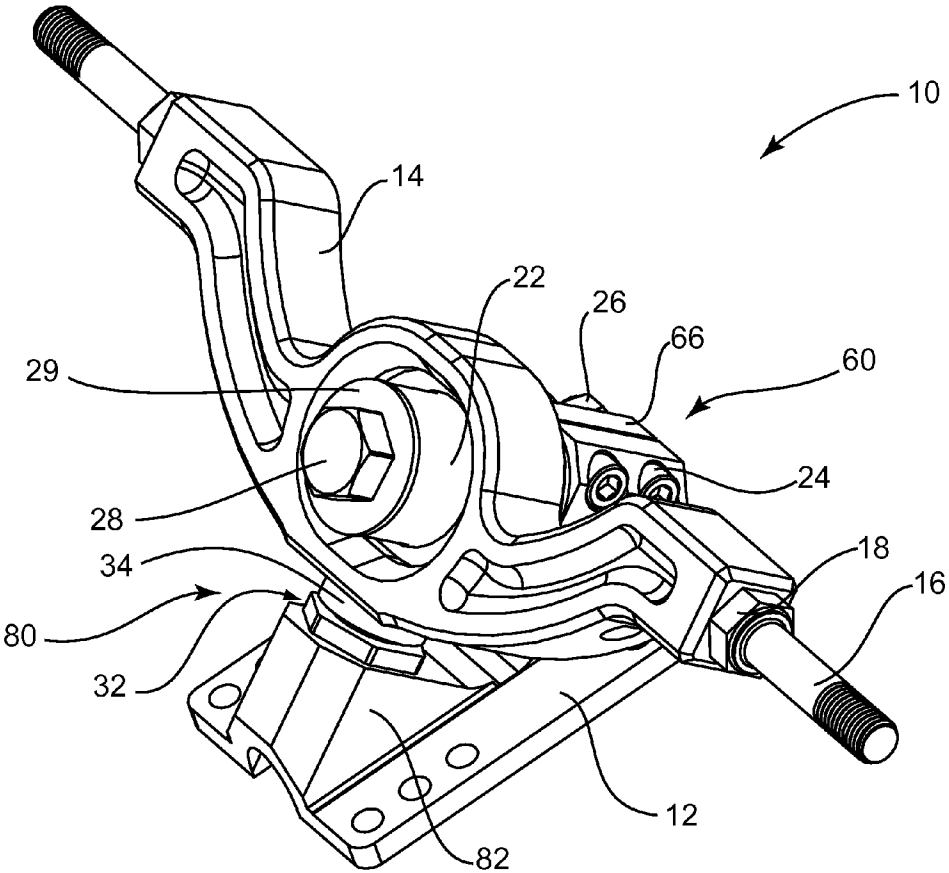
Figure 3:
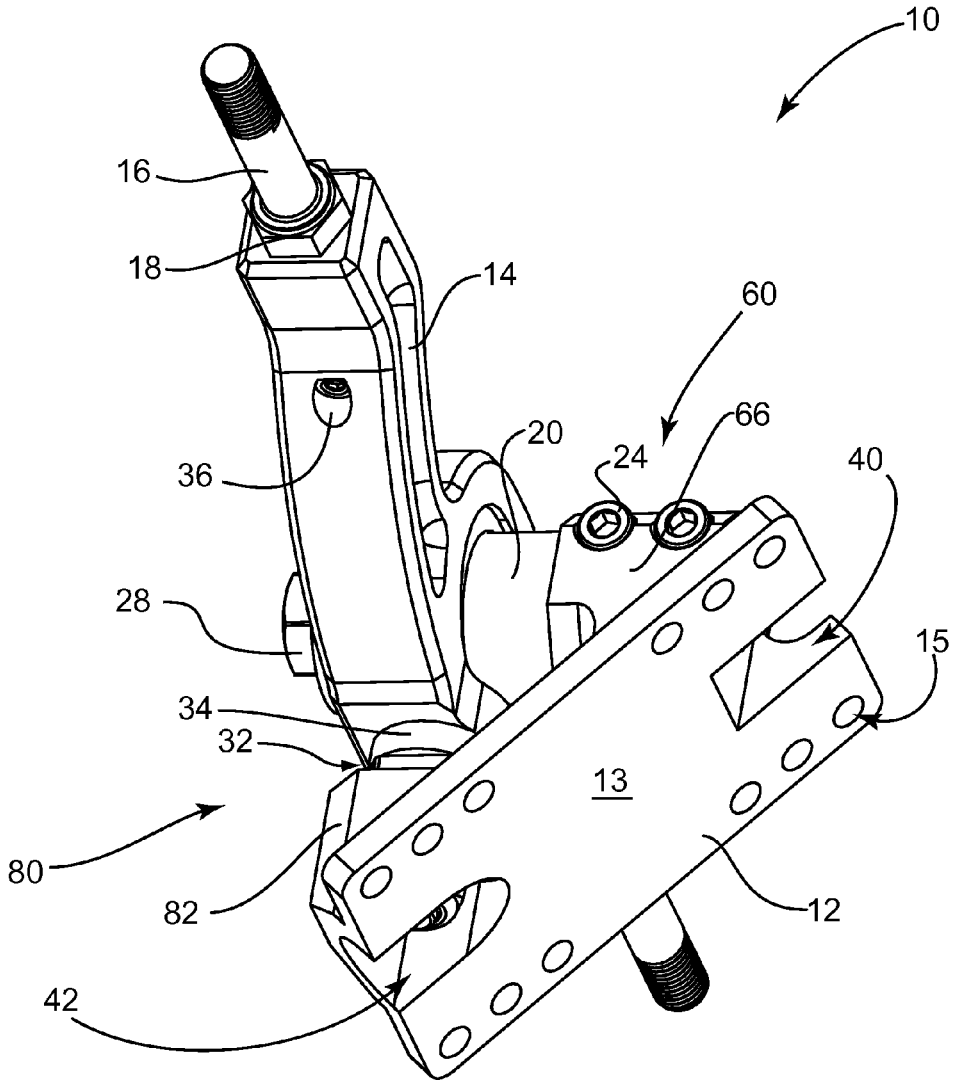
Figure 4:
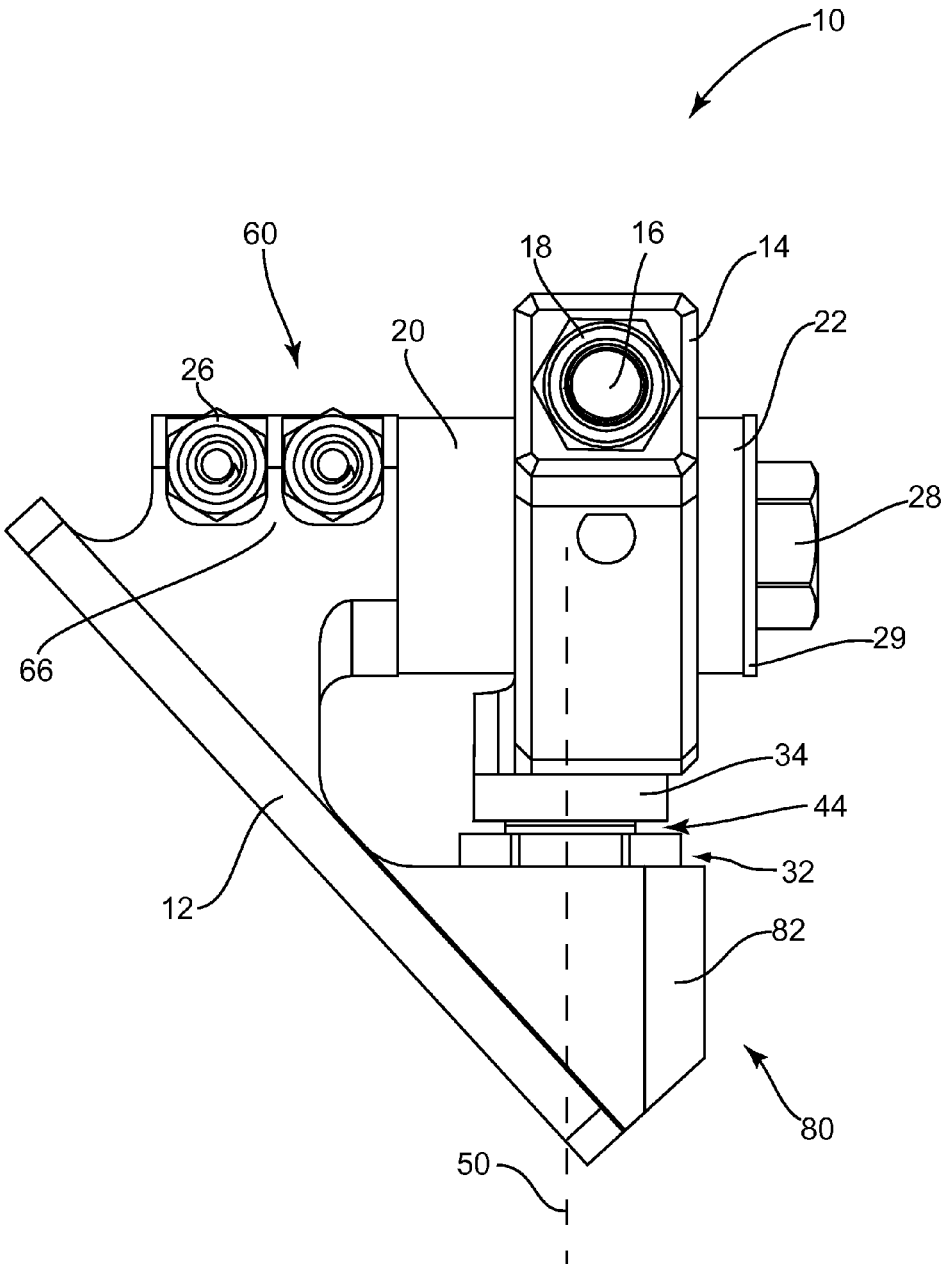
FIG. 4 is a side view of a skateboard truck.
Figure 5:
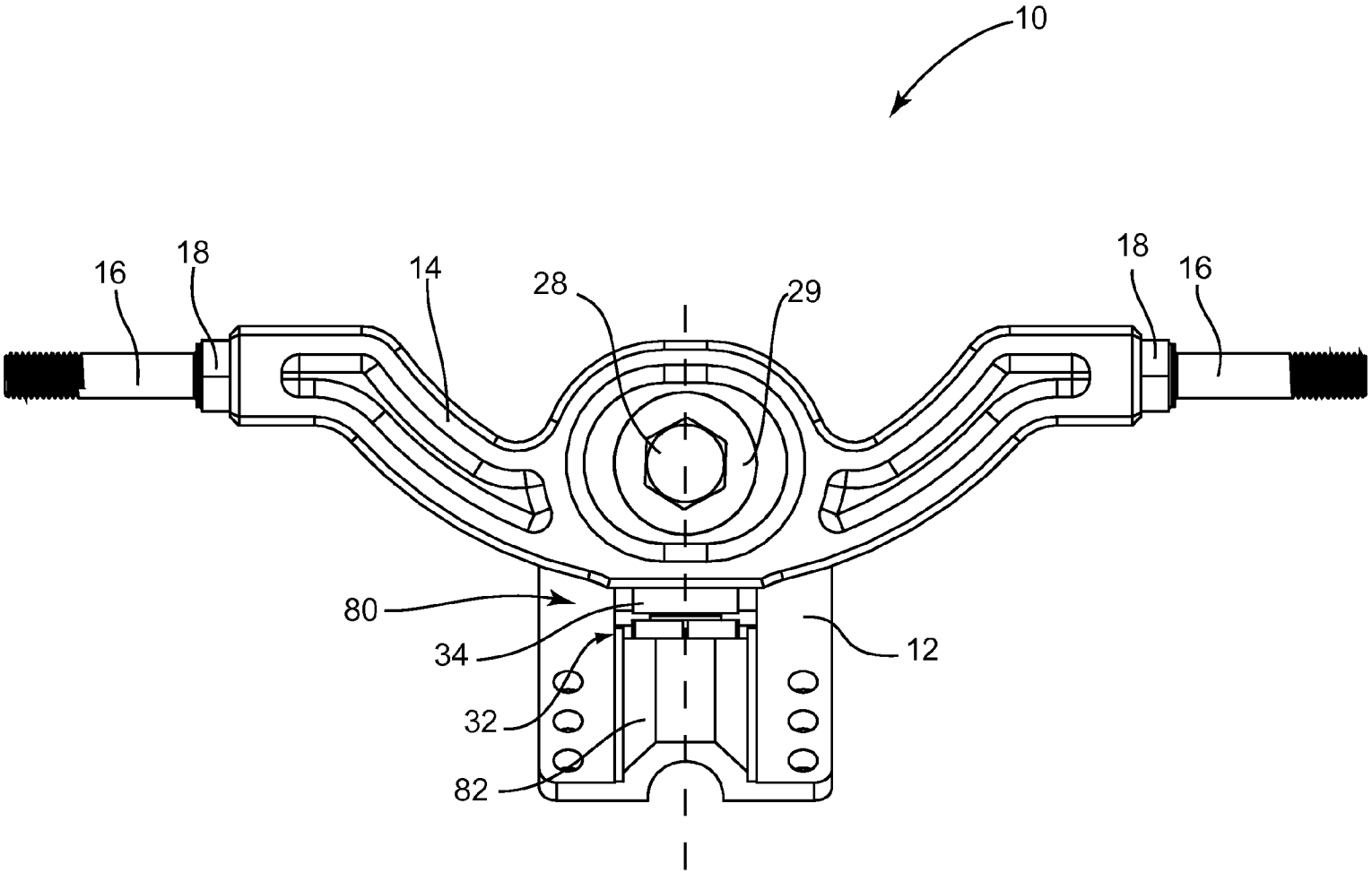
FIG. 5 is a front view of a skateboard truck.
Figure 6:
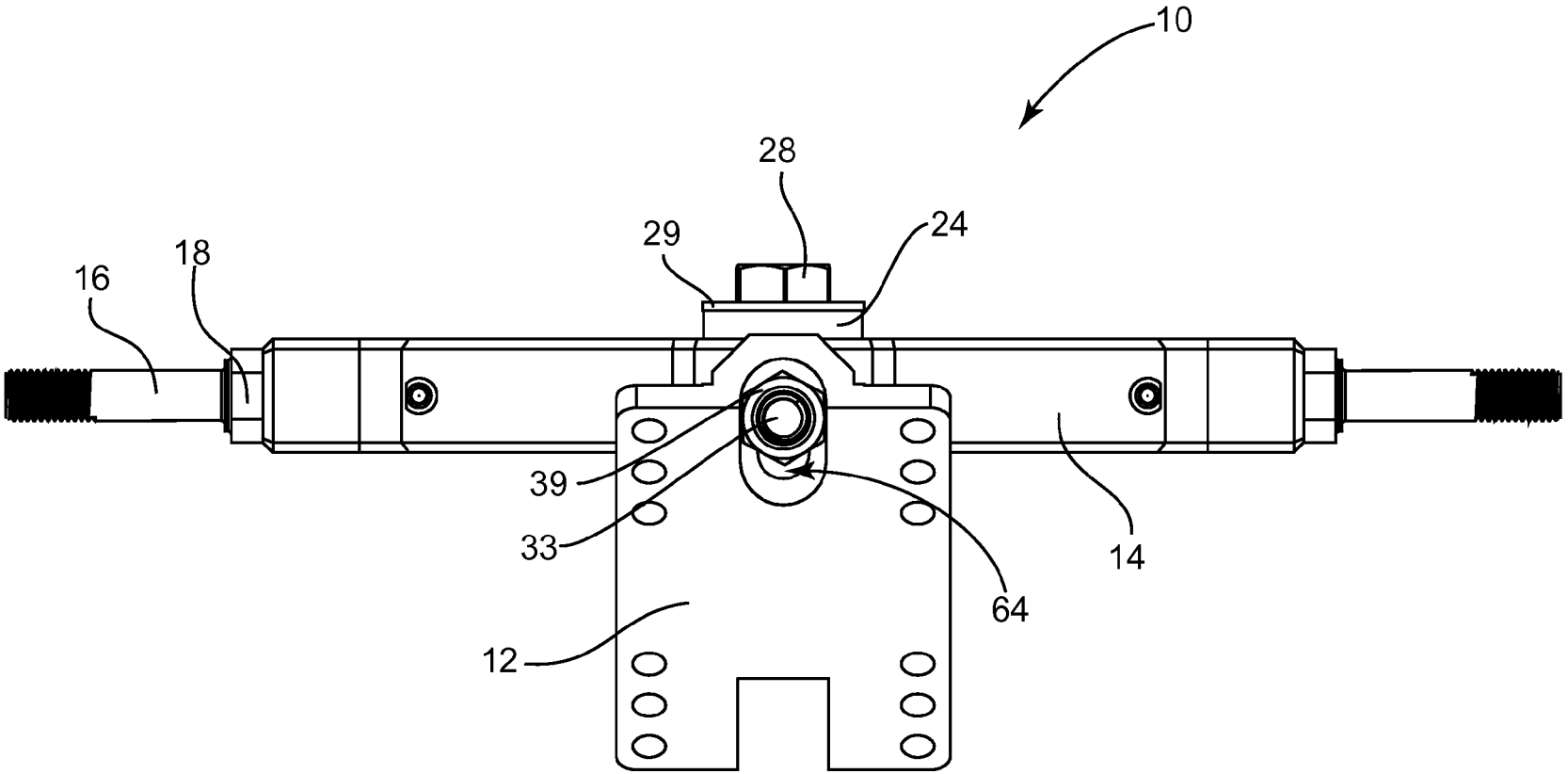
FIG. 6 is a bottom view of a skateboard truck.

As discussed above, embodiments of the present invention relate to a skateboard truck with a pivot alignment system, wherein the pivot axis alignment is not controlled by the tightening and loosening of the kingpin. Generally, a skateboard truck in accordance with embodiments of the present invention comprises a base plate, a kingpin, a hanger and pivot alignment system.

Referring to the drawings, FIGS. 1-6 depict a skateboard truck 10 according to particular embodiments. The truck 10 comprises a base plate 12, a hanger 14, a kingpin 28 and a pivot alignment system 80. The kingpin 28 is used to couple the hanger 14 to the base plate 12. The pivot alignment system 80 ensures that the pivot angle is maintained after the hanger 14 is coupled to the base plate 12.

The truck 10 also comprises bushings 20 and 22, a kingpin washer 29, an axle 16 and axle nuts 18 coupled to the hanger 14, a kingpin clamping device 60 that includes, among other things a kingpin aperture 30 and clamping members 24. The pivot alignment system 80 comprises a pivot rod 32, a bearing 44 coupled within a recess 36 of the hanger 14 (shown in FIG. 8A), and slot 64 in the base 12. The slot 64 extends through the pivot protrusion 82.

Further, the base plate 12 includes a bottom surface 13 that is coupled adjacent a skateboard deck. The base plate 12 also includes a slot recess 42, wherein the recess 42 receives a connector for securing the pivot rod 32 within the slot 64 such that the pivot rod 32 and the connector do not extend beyond the bottom surface 13 of the base plate 12, so as to not interfere with coupling of the base plate 12 to a deck of a skateboard. The base plate also includes kingpin recess 40 to allow the kingpin 28 to extend through the kingpin aperture 30 and not engage the bottom surface 13 of the base plate 12.

Figure 7A:
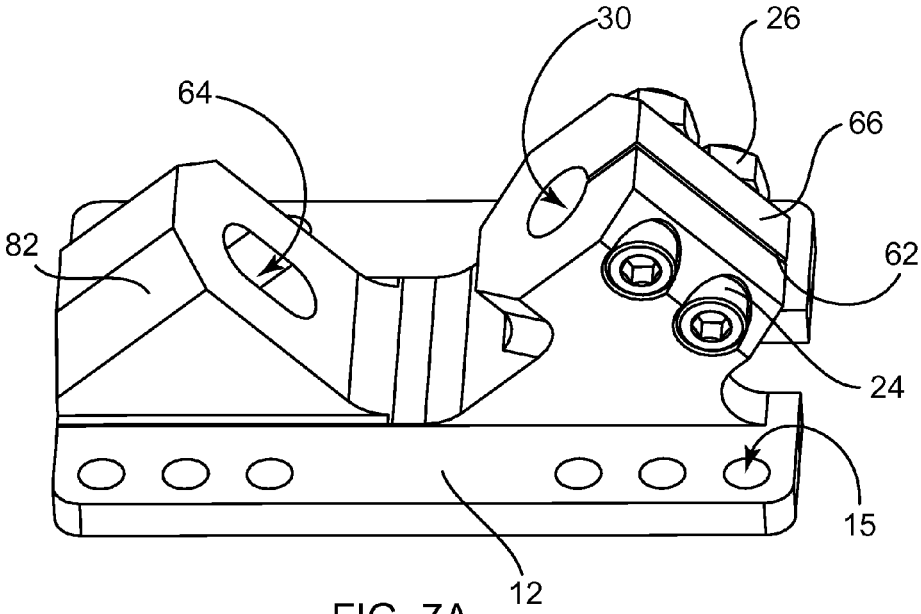
FIG. 7A is a perspective view of a base plate of a skateboard truck.
Figure 7B:
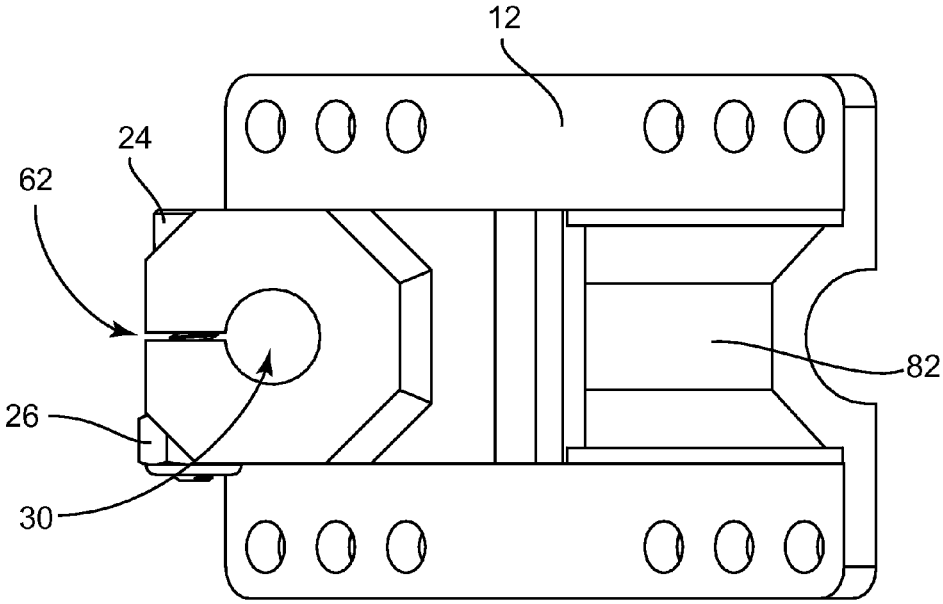
FIG. 7B is a front view of a base plate of a skateboard truck.
Figure 7C:
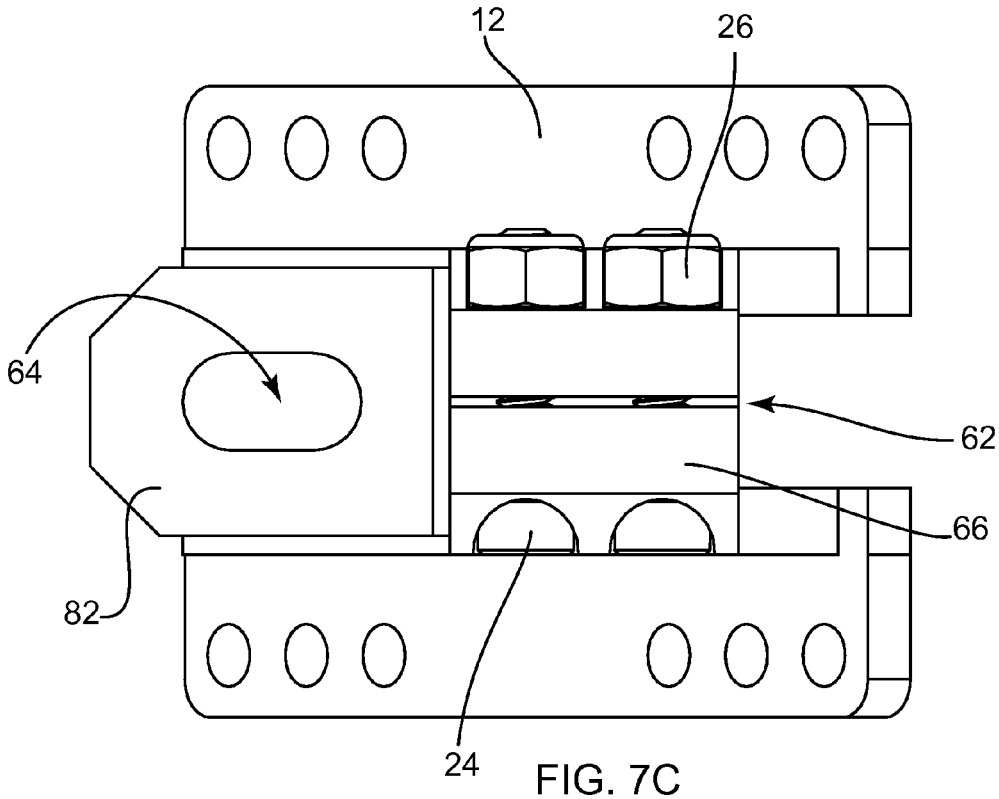
FIG. 7C is a rear view of a base plate of a skateboard truck.

Referring again to the drawings, FIGS. 7A-7C depicts a base plate 12 of particular embodiments of a skateboard truck. The base plate 12 comprises pivot protrusion 82. The pivot protrusion 82 comprises a slot 64 that extends through the pivot protrusion 82. As described previously, the base plate 12 further includes a slot recess 42, wherein the recess 42 receives a connector for securing the pivot rod 32 within the slot 64 such that the pivot rod 32 and the connector do not extend beyond the bottom surface 13 of the base plate 12, so as to not interfere with coupling of the base plate 12 to a deck of a skateboard.

The base plate 12 also includes a kingpin protrusion 66 that comprises a kingpin clamping device 60. The kingpin clamping device 60 includes a kingpin aperture 30, a clamp slot 62 and clamping members 24. In some embodiments the clamping members 24 are bolts with corresponding nuts 26. In some embodiments the kingpin aperture 30 is threaded, the threads corresponding to the threads of the kingpin 28.

Figure 8A:
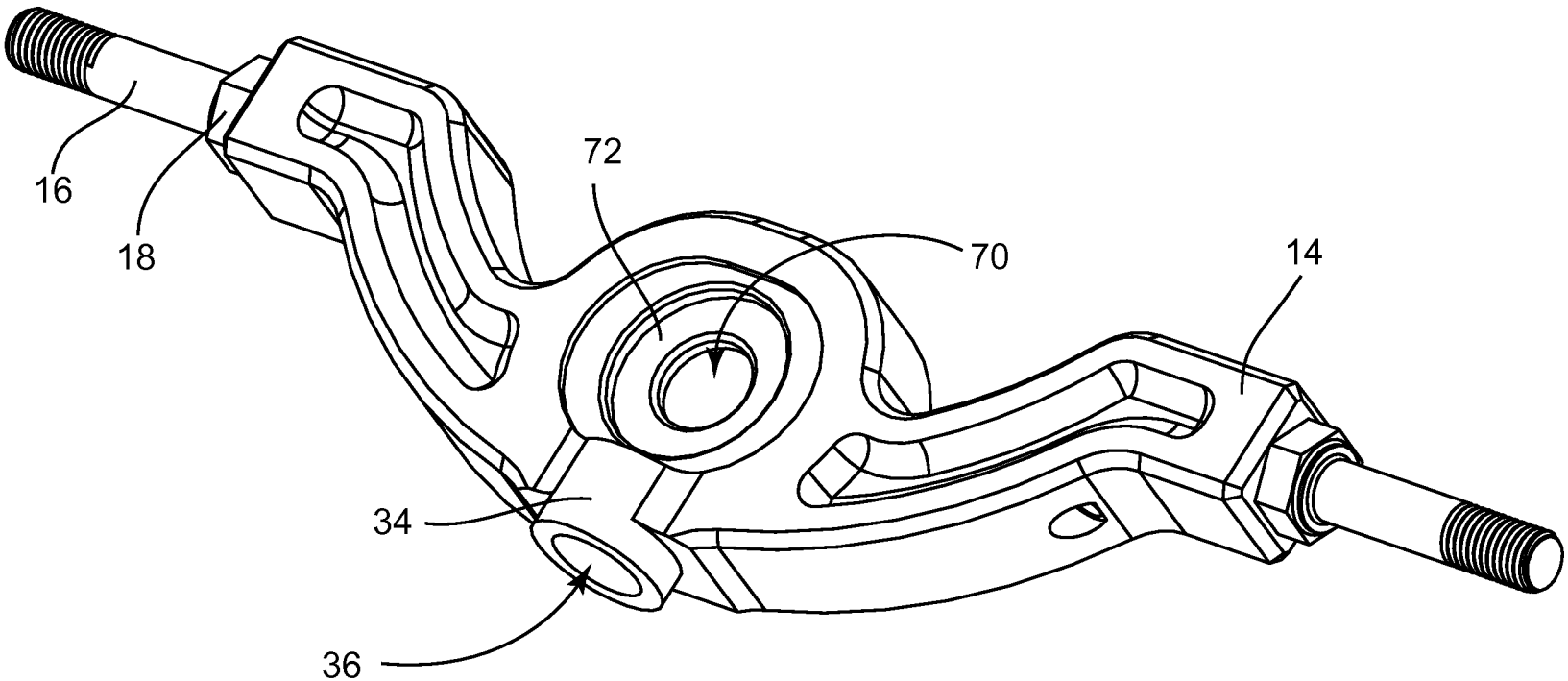
FIG. 8A is a perspective view of a hanger of a skateboard truck.
Figure 8B:
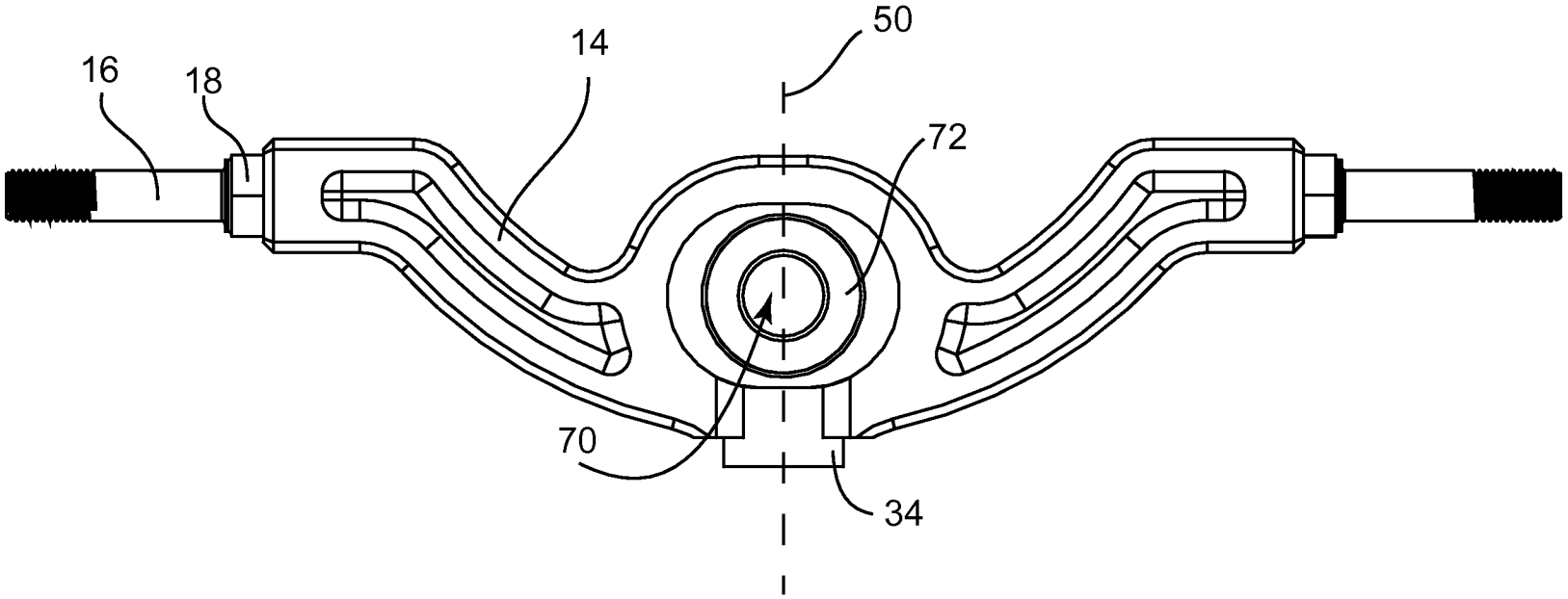
FIG. 8B is a front view of a hanger of a skateboard truck.
Figure 8C:
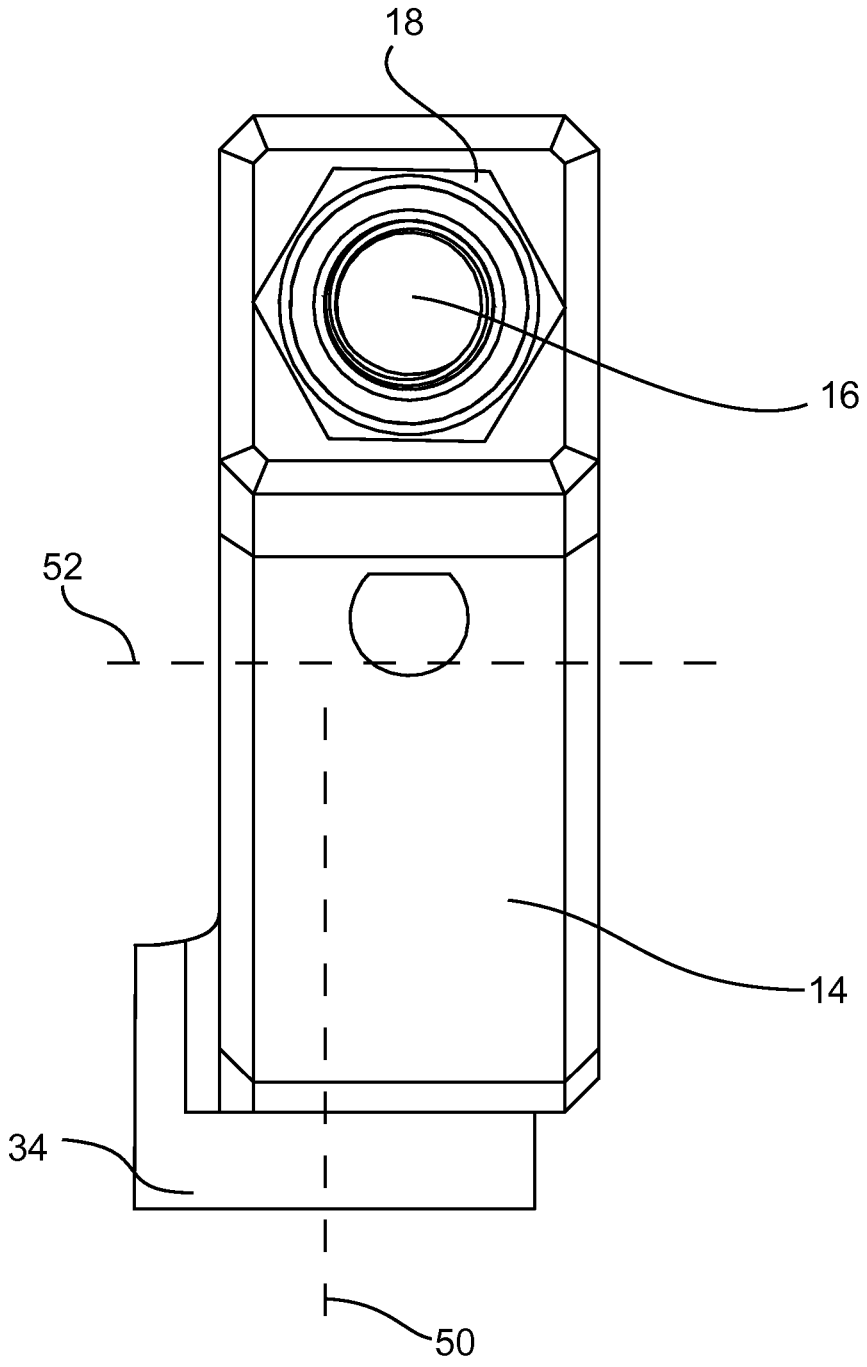
FIG. 8C is a side view of a hanger of a skateboard truck.

Referring again to the drawings, FIGS. 8A-8C depict a hanger 14 according to particular embodiments. The hanger 14 comprises an axle 16, axle bolts 18, an aperture 70, an alignment protrusion 34 with an alignment recess 36 and a bushing recess 72, wherein the bushing recess 72 is a recess on both sides of the hanger 14. The aperture 70 allows for the kingpin 28 to extend through the hanger 14. The alignment recess 36 receives the bearing 44 within the recess 36.

Referring to FIGS. 1-6, 7D, 8A-8D and 9A-9B, the skateboard truck 10 comprises an assembly of various components in a specific manner in order to allow for proper alignment of the pivot axis.

Accordingly, an example of the assembly of the truck 10 includes the following. The kingpin 28 is extended through a washer 29, a bushing 22, the hanger 14 from the first side 11 through the second side 15, and a bushing 20. In this embodiment, the order of these components on the kingpin 28 allows for proper function of the truck 10. Next, the bearing 44, comprising an outer cylinder 46 and a corresponding inner cylinder 48 are coupled within the alignment recess 36 and the first end 31 of pivot rod 32 is operatively coupled to the bearing 44. The bearing 44 shown to be an outer cylinder 46 and inner cylinder 48 operatively coupled together may be formed of any proper material, such as, but not limited to urethane, plastic, metal, composites and the like. Further the bearing 44 may be any other type of bearing that can receive the first end 31 of the pivot rod 32, for example and without limitation, bearing 44 may include outer cylinder 46 and inner cylinder 48 formed as a unitary component. In this condition, the hanger 14 with the coupled components described above may be coupled to the base plate 12.

Figure 9A:
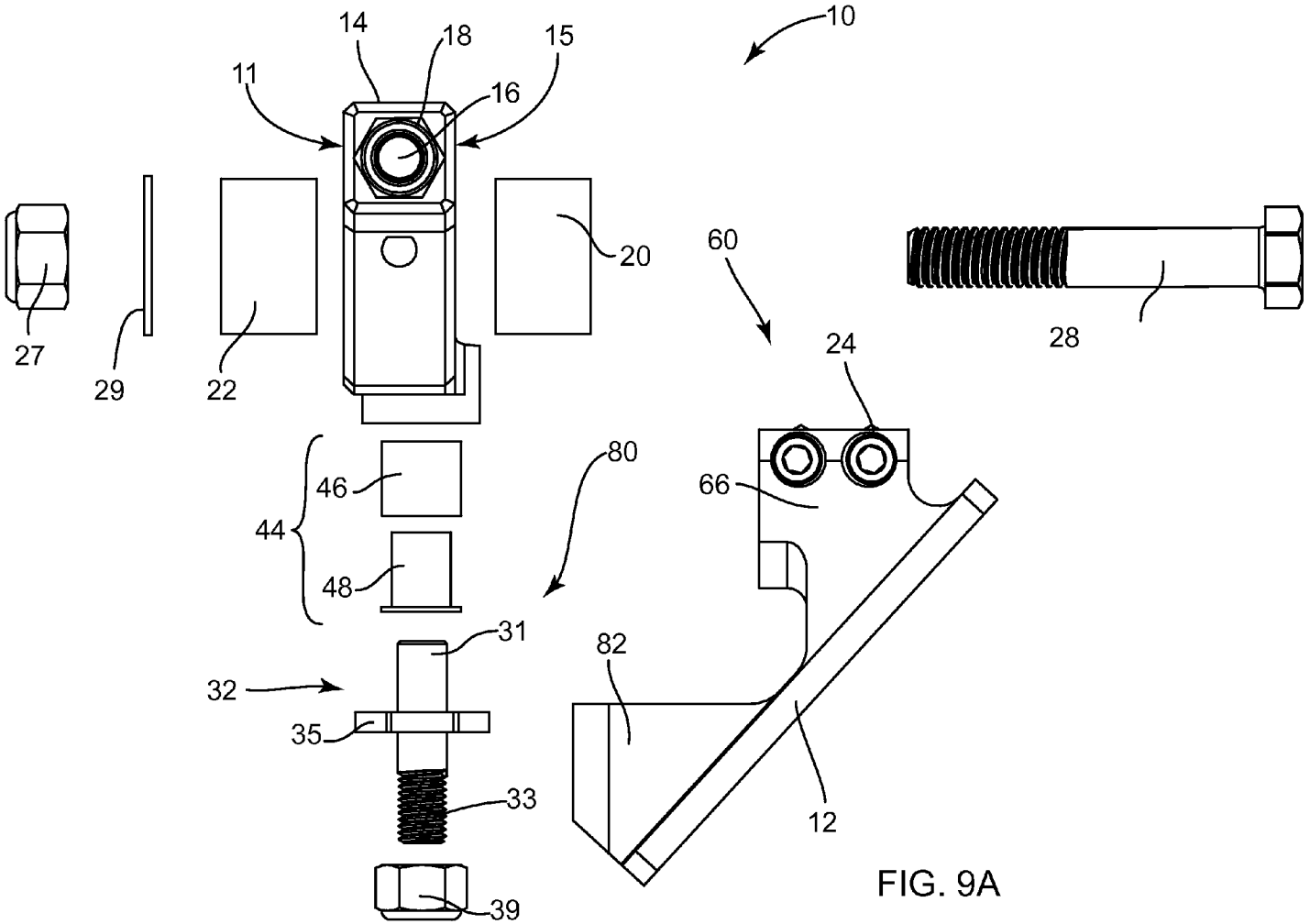
FIG. 9A is a side exploded view of a skateboard truck.
Figure 9B:
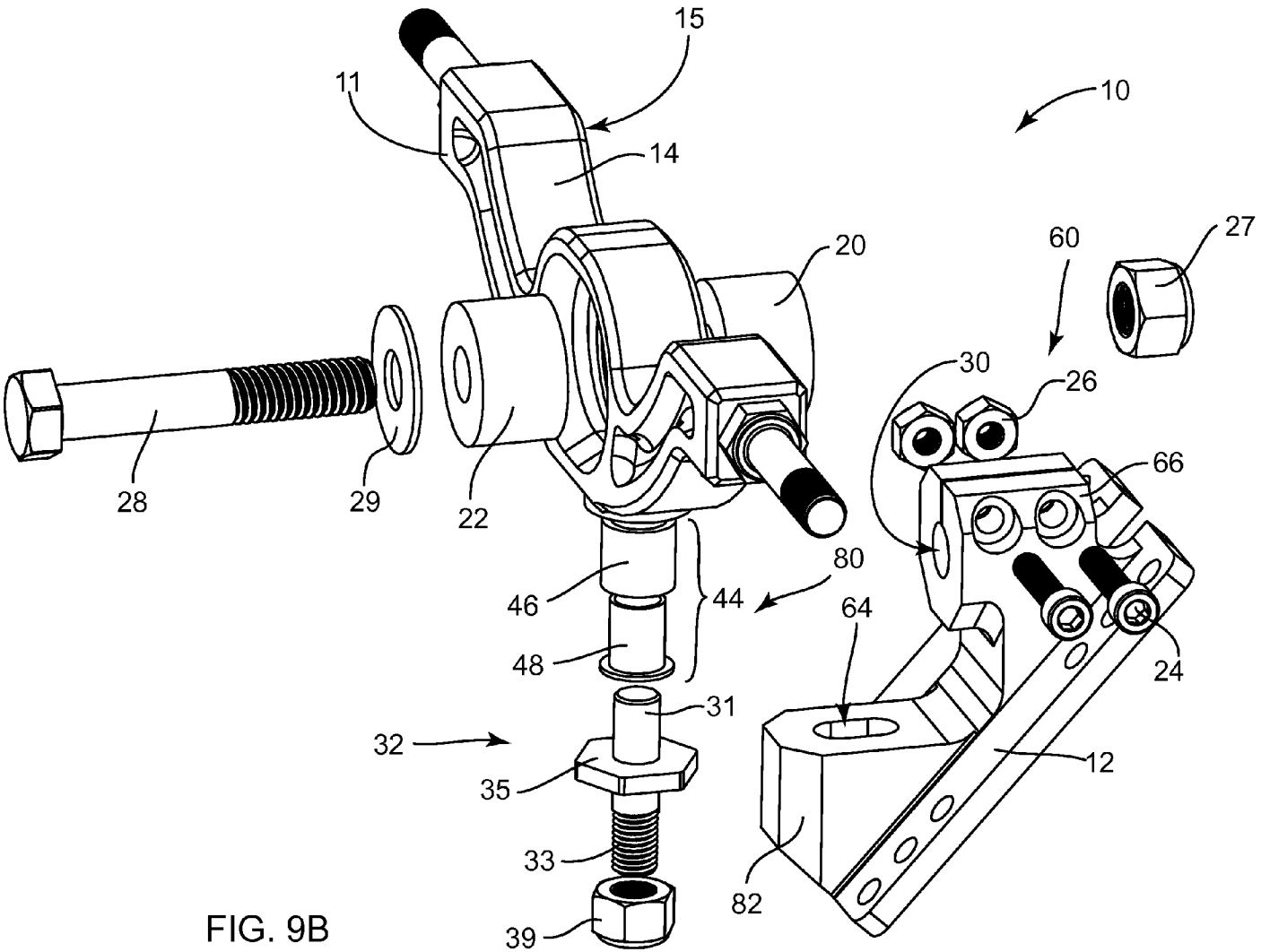
FIG. 9B is a perspective exploded view of a skateboard truck.

In this example of the truck 10 as indicated previously, the second end 33 of the pivot rod 32 is extended through the slot 64 of the pivot protrusion 82 and engages the connector 39. The connector 39 is tightened, but does not clamp the opposing ends of the slot between the connector 39 and the slot engagement member 35 of the pivot rod 32. In this condition, the pivot rod 32 may slide within the slot 64. The kingpin 28 may then be coupled in the kingpin aperture 30. In some embodiments, this includes extending the kingpin 28 through the kingpin aperture 30 and a nut 27 engages the kingpin 28 in order to couple the kingpin 28 in the kingpin aperture 30. The kingpin 28 may extend through the kingpin aperture 30 from either side of the kingpin aperture 30 as shown in FIGS. 9A and 9B. In other embodiments, this includes a threaded engagement between the kingpin 28 and the kingpin aperture 30. The kingpin 28 is tightened until the bushings 20 and 22 are seated in the bushing recesses 72 and the bushings 20 and 22 are compressed according to the user's determination. The clamping device 60 may then be used to engage the kingpin 28. The clamping device 60 engages the king pin 28 by tightening the clamping members 24, which in this example are bolts 24 with nuts 26 that are tightened. The width of the slot 62 is reduced in response to the tightening of the bolts 24 with the nuts 26. This reduces the radius of aperture 30, thereby securely engaging the kingpin 28. In this condition, the kingpin 28 is prohibited from moving axially along axis 52 and further prohibited from moving radially, and combinations thereof. Axis 52 extends through the kingpin aperture 30 and the aperture 70 of the hanger 14.

As the kingpin 28 is being tightened and the clamping mechanism is operated to engage the kingpin 28, pivot alignment system 80 also operates to align a pivot axis 50. The pivot alignment system 80 allows the pivot rod 32 to slide within the slot 64 as the kingpin 28 is tightened or loosened. This ensures that the pivot axis 50 that extends through the pivot rod and the alignment recess 36 of hanger 14 remain aligned. This aligned axis is then placed into a static position by tightening of the connector 39. In some embodiments, the slot recess 42 of the base plate 12 is of a size and shape to receive a connector 39, such as, a nut, wherein the nut is held in a fixed orientation by engaging flat surfaces of the slot recess 42. The pivot rod 32 includes a plate engagement member 35 with a first end 31 and an opposing second end 33. The first end 31 engages the bearing 44 that is coupled within the recess 36 of the hanger 14. The second end 33 extends through the slot 64 and engages the connector 39. For example, the second end 33 may be threaded and engage the connector 39 that is a nut. The connector 39 may be tightly secured in response to rotating the pivot rod 32 by use of the slot engagement member 35. The slot engagement member 35 may be hexagonal in shape so as to be rotatable by use of a wrench. As the connector 39 is tightly secured, the connector 39 and the plate engagement member 35 clamp opposing ends of the slot 64 between the connector 39 and the plate engagement member 35, thereby securing the pivot rod 32 in a stationary position and maintaining the pivot axis 50 in a static position. In this way, the pivot rod 32 is moved from a disengaged to an engaged position. Loosening the connector 39, in turn moves the pivot rod from an engaged position to a disengaged position.

Figure 7D:
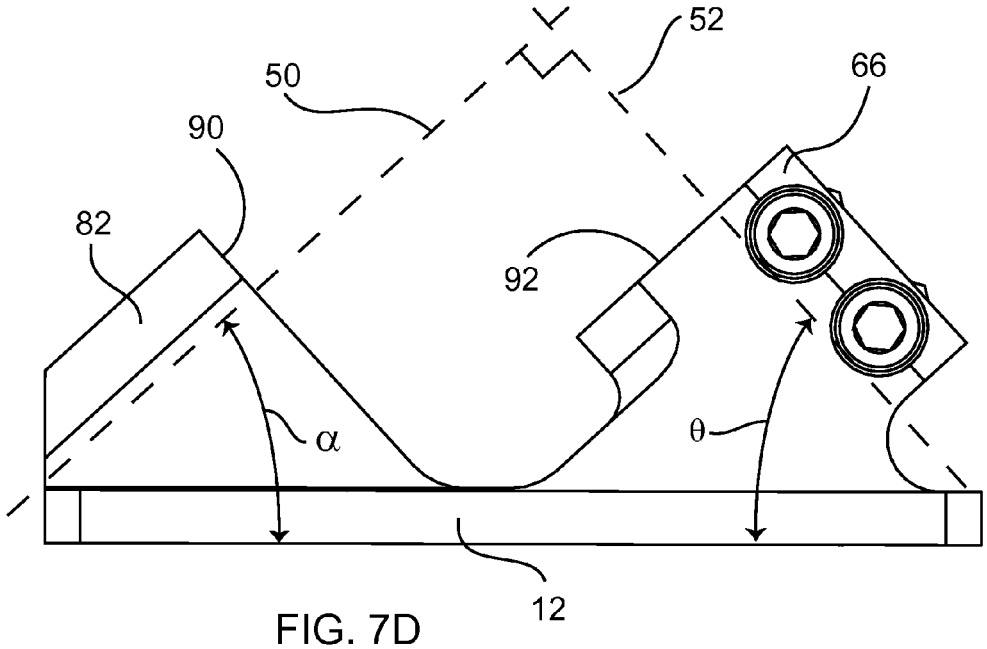
FIG. 7D is a side view of a base plate of a skateboard truck.

The pivot axis 50 and the kingpin axis 52 are substantially perpendicular to each other, with each oriented at respective predetermined angles $\alpha$ and $\theta$ with respect to the bottom surface 13 of the base plate 12. These angles $\alpha$ and $\theta$, as shown in FIG. 7D, are complementary angles and may be different in some embodiments and equal in other embodiments. The pivot protrusion 82 includes an angled surface 90 and the kingpin protrusion 66 includes an angles surface 92. Angled surface 90 is substantially parallel to kingpin axis 52 and angled surface 92 is substantially parallel to pivot axis 50. With these characteristics, embodiments of the present invention operate to keep the pivot axis 50 and the kingpin axis 52 in substantial transverse relationship to each other. This then allows for proper operation of the truck 10 as described in this disclosure.

It will be understood that the truck 10 may be assembled prior to mounting the truck to the skateboard deck. Further, the base plate 12 may be mounted to the skateboard deck and then the hanger 14 to the base plate 12. Further, once the truck 10 is assembled, skateboard wheels may be coupled to the truck on axle 16 of the hanger.

Alignment of the pivot axis 50 provides several benefits not realized by conventional trucks. The alignment allows for proper engagement of the bushings 20 and 22 during turning maneuvers of the skateboard allowing for consistent compression of the truck and consistent, predictable steering capabilities of the truck. The wear of the components of the truck 10 is reduced by properly aligning the components to ensure they engage each other as designed and limiting undue forces applied to the truck components. Further, the kingpin clamping device 60 prevents movement of the kingpin 28, which prevents unwanted movement of the hanger 14. In high speed applications, such as downhill riding, the prohibited movement of the kingpin 28 reduces wear of the truck, and increases safety by preventing the introduction of unwanted movement of the truck during riding of the skateboard, which can affect the user's ability to steer and control the skateboard. Further, the durometer of the bushings 20 and 22 and the wheels can be selected according to the user's riding preference and feel.

According to embodiments of the present invention, a method of assembling a skateboard truck may include the steps of coupling a pivot rod to a slot of a base plate in a disengaged position; coupling a hanger to the base plate in response to coupling a kingpin to a kingpin clamping device of the base plate, wherein the pivot rod is coupled to a bearing within a recess of the hanger; prohibiting axial and radial movement of the kingpin in response to clamping the kingpin clamping device around the kingpin; and placing the pivot rod in an engaged position, wherein the axis of the pivot rod is aligned with the axis of the recess of the hanger.

The components defining any embodiment of a skateboard truck 10 may be formed of any of many different types of materials or combinations thereof that can readily be formed into shaped objects provided that the components selected are consistent with the intended operation of a skateboard truck 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of the skateboard truck 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A skateboard truck comprising:

a hanger;

a kingpin that functionally engages the hanger;

a base plate comprising a kingpin clamping device comprising a kingpin aperture and clamping members, wherein the kingpin clamping device engages the kingpin and clamps around the circumference of the kingpin;

a kingpin protrusion, wherein the kingpin protrusion comprises the kingpin clamping device; and a clamp slot extending the length of the kingpin protrusion, wherein a width of the clamp slot is reduced in response to tightening of the clamping members.

2. The skateboard truck of claim 1, wherein the kingpin is prohibited from axial and radial movement with respect to a kingpin axis in response to clamping the kingpin clamping device around the kingpin.

3. The skateboard truck of claim 1, wherein the kingpin is removably coupled within the kingpin aperture in response to engaging the clamping members.

4. The skateboard truck of claim 1, wherein a radius of the kingpin aperture is reduced in response to reducing the width of the clamp slot.

5. A skateboard truck comprising:

a base plate;

a hanger; and a pivot alignment system comprising:

a recess in the hanger;

a bearing coupled within the recess of the hanger;

a slot within the base plate; and a pivot rod coupled to each of the slot and the bearing, wherein:

a second end of the pivot rod extends through the slot and a first end engages the bearing within the recess of the hanger; and the pivot rod comprises an engaged and disengaged position, wherein in the disengaged position, the pivot rod is slideable within the slot and in the engaged position, the pivot rod is secured within the slot aligning the axis of the pivot rod with the axis of the recess of the hanger.

6. The skateboard truck of claim 5, wherein in the disengaged position, the pivot rod slides within the slot in response to tightening or loosening of a kingpin of the skateboard truck to maintain alignment of the axis of the pivot rod with the axis of the recess of the hanger.

7. The skateboard truck of claim 5, wherein the base plate comprises a pivot protrusion.

8. The skateboard truck of claim 7, wherein the pivot protrusion comprises the slot.

* * * * *